United States Patent [19]

Zemke

[11] 3,983,679

[45] Oct. 5, 1976

[54] APPARATUS AND METHOD OF PROCESSING MAIL

[75] Inventor: Edward H. Zemke, Chicago, Ill.

[73] Assignee: Bell & Howell Company, Chicago, Ill.

[22] Filed: May 30, 1975

[21] Appl. No.: 582,360

[52] U.S. Cl. ..... 53/21 FW; 53/31; 53/59 R

[51] Int. Cl.[2] ..... B65B 63/04

[58] Field of Search ..... 53/21 FW, 31, 59 R, 53/117, 206, 266 A, 53, 54; 83/287, 296; 93/61 AL, 73; 270/21, 55, 62, 66

[56] References Cited

UNITED STATES PATENTS

| | | | |
|---|---|---|---|
| 795,519 | 7/1905 | Lang et al. | 270/62 |
| 1,115,600 | 11/1914 | Shrady | 53/206 X |
| 1,779,105 | 10/1930 | Price | 53/117 X |
| 2,922,519 | 1/1960 | Radley | 53/53 X |
| 3,059,391 | 10/1962 | Volks et al. | 53/206 |
| 3,424,041 | 1/1969 | Giraud | 83/287 X |
| 3,706,450 | 12/1972 | Gerstenberger et al. | 270/62 X |
| 3,789,571 | 2/1974 | Tall et al. | 53/59 R |
| 3,820,447 | 6/1974 | Gendron et al. | 93/73 |

*Primary Examiner*—Travis S. McGehee
*Assistant Examiner*—John Sipos
*Attorney, Agent, or Firm*—Griffin, Branigan and Butler

[57] ABSTRACT

A mail or letter preparing system prepares both "self mailers" and envelope letters for mailing. The system includes apparatus for cutting individual-page letter sheets or leaving letter sheets as united pages. The united page sheets are folded by a first folder to be the same size as individual-page sheets. A second folder then folds both the individual sheets and the united-page sheets to letters of a predetermined envelope size. Also under the control of a central computer, a sealer seals some of these folded letters for mailing as they are and transports the others "as self-mailers" to inserter apparatus. Likewise, the inserter apparatus after adding any additional inserts which are to accompany enveloped letters, stuffs the unsealed letters into respective envelopes, but merely transports the sealed self mailers there-through without stuffing them into envelopes. Both stuffed envelopes and self mailers are expelled from the inserter from the same exit and transported by the same conveyor to a sorter. The sorter sorts these items to be mailed in accordance with instructions from the central computer.

8 Claims, 3 Drawing Figures

APPARATUS AND METHOD OF PROCESSING MAIL

BACKGROUND OF THE INVENTION

This invention relates broadly to sheet handling devices, and more particularly to mail or letter preparation equipment.

There are many systems in the prior art for controlling the preparation of large numbers of letters and inserts for mailing to individuals on a large volume basis. For example, many such systems exist for counting and stacking cancelled checks, adding advertising inserts and bank statements to the cancelled checks, and stuffing all of these materials into single envelopes. Some such systems have sufficient flexibility to include appropriate advertising materials to fit the individuals receiving the checks and statements. Most such systems employ cards having readable codes imprinted thereon for instructing insert apparatus and other components to process mailings in certain manners. Such systems, however, do not provide the flexibility of allowing a business to process large mailings of both stuffed envelopes and "self mailers" which do not require envelopes. Thus, it is an object of this invention to provide both apparatus and a method for processing mail including both stuffed envelopes and self mailers to fit the individuals receiving the mail.

Yet another difficulty with the above described prior art is that it does not allow easy preparation of tailored letters to fit varieties of individuals. It is therefore yet another object of this invention to provide apparatus and a method for preparing letters tailored to be sent to a variety of individuals.

A difficulty which has been encountered in the past in trying to process form letters tailored to meet the needs of various sendees is that some of the letters involve more pages than others and it is difficult for the same equipment to be used to process letters having different numbers of pages. Hence, it is another object of this invention to provide apparatus and a method of preparing tailored letters using the same equipment to process letters that vary in length and, consequently, number of pages.

SUMMARY OF THE INVENTION

According to principals of this invention, letter processing apparatus are under the control of a central computer. Printed material including addresses and letter text, are printed on a continuous sheet of paper. A perforator places lines of perforations between printed material corresponding to single pages of paper. A cutter then cuts selected ones of these perforated lines so as to provide either individual-page sheets, sheets of two pages, or sheets of three pages. The two-and three-page sheets are then folded to the size of an individual-page sheet by a first folder and then both the individual-page sheets and the multi-page sheets are folded to the size of folded letters. Some of the folded letters are sealed in this condition by a sealer, and these items are then ready to be mailed as self mailers. Both the self mailers and the unsealed folded letters are fed through an accumulator and an inserter. The unsealed folded letters are combined with inserts or with each other and then stuffed into envelopes. The self mailers are fed through both the accumulator and the inserter without being operated on. All of these are then fed to a sorter and sorted for mailing.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Turning to the drawings, a paper supply roll 10 provides a continuous web or sheet of paper 12 which is twelve inches (12 inches) wide and which has prepunched feed holes 14 on both sides thereof.

Figure 1:
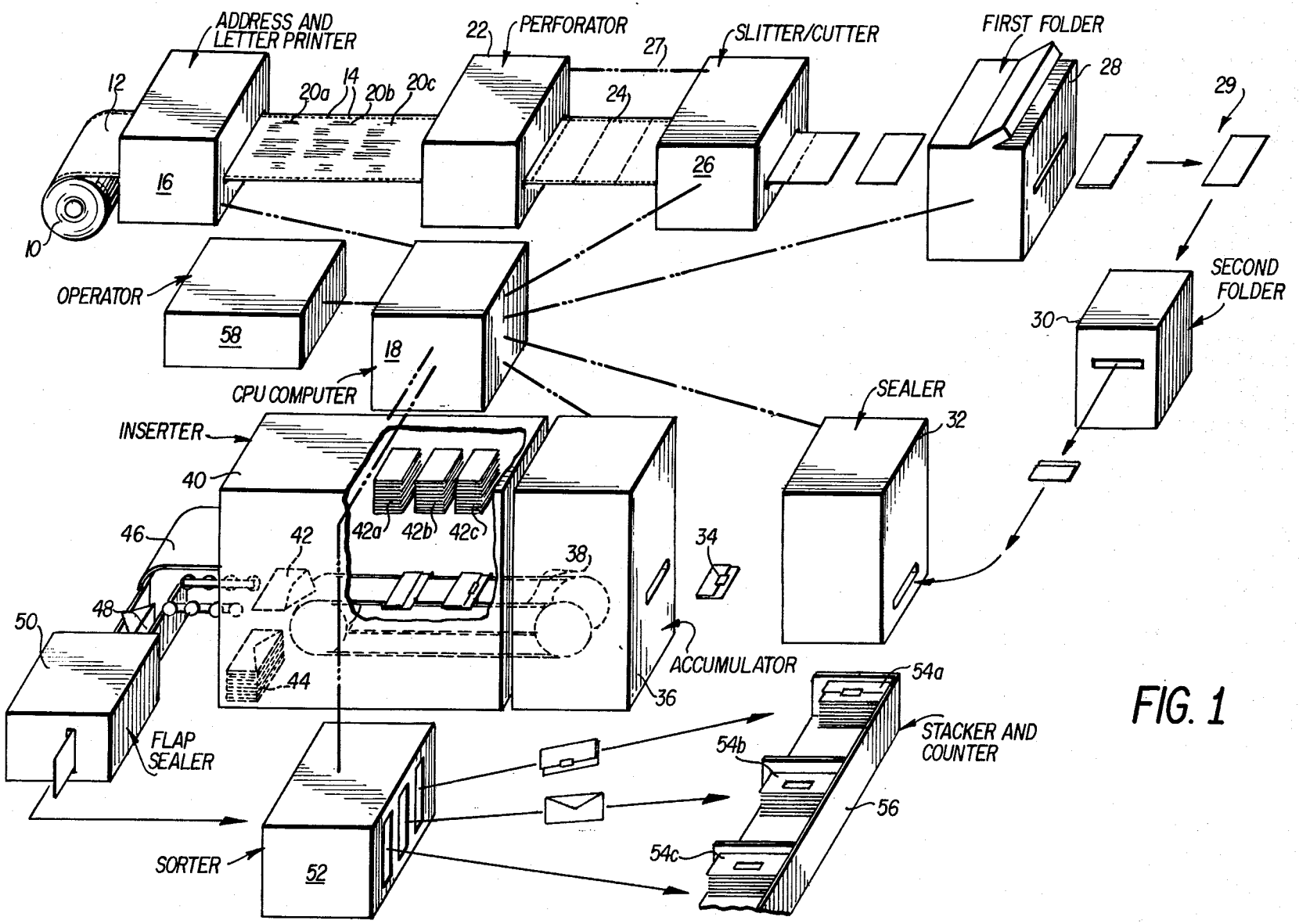
FIG. 1 is a schematic block diagram of over-all apparatus of this invention for performing the method of this invention.

The continuous sheet of paper 12 first passes through an address-and-letter printer 16. Although this item is depicted in FIG. 1 as being a single unit, in one embodiment there are separate address and letter printers. As is the case with all of the components of this system, the printers are well known in the prior art and are therefore not described in detail herein. This item is under the control of a computer (CPU) 18, as are many of the other components to be described below. The address and letter printer 16 prints the text of letters on the upper surface of the continuous sheet of paper 12 and the addresses of the respective letters on the underside thereof. Again, this is done under the control of the CPU 18. It can be seen in FIG. 1 that the address and letter printer 16 prints letters from the top-to-bottom thereof from side-to-side of the continuous sheet of paper 12. Three such letters are indicated as 20 *a*, *b*, and *c* in FIG. 1.

The twelve inch wide continuous sheet of paper 12 is then fed to a perforator 22. The perforator places a perforation line crosswise of the continuous sheet of paper 12 every 8.5 inches of paper travel, with the perforation lines falling between letters, such as letters 20*a*, *b* and *c*. The perforator is a modified guillotine-type cutter which has been modified to perforate rather than cut. Such cutters are well known in the prior art.

Next, the continuous sheet of paper 12 travels through a slitter/cutter 26. A common drive 27 between the perforator 22 and the slitter/cutter 26 provides synchronization between these two machines. The slitter/cutter 26 "slits" the continuous sheet of paper 12 longitudinally to remove pin feed margin strips, including the feed holes 14, from the outer edges of the continuous sheet of paper 12. Next, the slitter/-cutter 26, under instructions from the CPU 18, cuts along some of the perforation lines so as to form sheets of one, two or three pages (8.5, 17 or 25.5 inches wide respectively). Slitters and cutters are old in the art, as was mentioned above, and it is not thought necessary to disclose in detail the structure of the slitter/cutter 26.

These sheets are now fed to a first folder 28. The first folder 28 is programmed by the CPU 18 to fold sheets which come therethrough to the size of an 11 × 8.5 inch individual-page sheet. Thus, a sheet which is 11 × 25.5 inches must be folded three times in the longitudinal direction. The CPU 18 must continually reprogram the first folder 28 to allow for different sizes of sheets. In a preferred embodiment the first folder is a buckle folder and the CPU 18 operates on fold-pan stops thereof for reprogramming purposes. However, other types of folders could also be used in this system.

Figure 2:
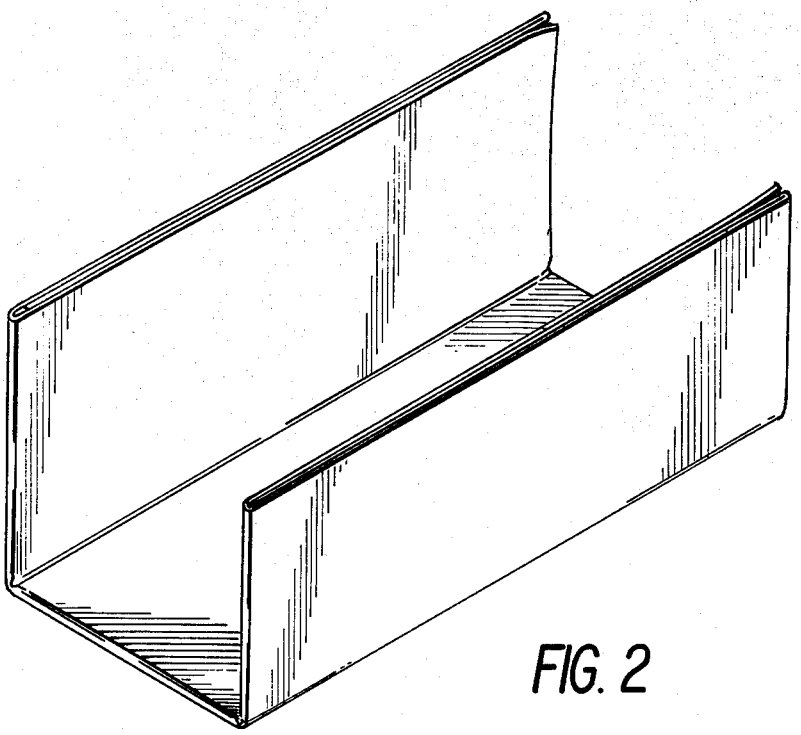
FIG. 2 is a perspective view of a multi-page sheet showing the manner in which it is folded by first and second folders.

After leaving the first folder 28, individual-page sheets and folded sheets go through a right-angle, flanking turn which has the purpose of orienting the mailed pieces in the proper direction for a second folder 30. The second folder 30 requires no controls. This unit folds every mail piece into thirds to fit into a No. 10 envelope. This folder is also preferably of the buckle folder type. FIG. 2 depicts a multi-page sheet that has been folded by the first and second folders.

Figure 3:
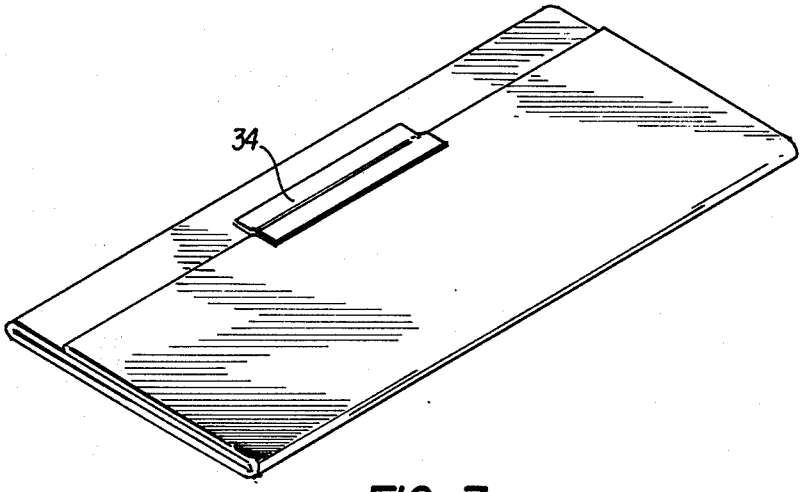
FIG. 3 is a perspective view of a self mailer after it has been sealed.

The folded sheets are then fed to a sealer 32 wherein, under control of the CPU 18, selected ones of the folded sheets have seals 34 (FIG. 3) placed thereon to maintain them in their folded attitudes. These folded sheets are thereby made to be "self mailers" and are ready to be mailed. That is, they have addresses printed on their opposite sides and want only stamps to be posted. Folded sheets or letters, destined for envelopes are passed through the sealer 32 without being sealed. In the preferred embodiment, the sealer 32 employs a water-soluble glue, however, heat-activated glue can be used to affix the seals. Such devices are in common use to apply labels to sheets, thus, it is not though necessary to describe the sealer in greater detail.

Both the sealed folded sheets (self mailers) and the unsealed folded sheets (letters) are fed to an accumulator 36. The accumulator 36 has two functions. The primary function of the accumulator 36 is to place both the letters and the self mailers onto inserter conveying chains 38. Further, the accumulator accumulates unsealed sheets for letters to be enveloped which consist of more than three pages. It should be recalled that the slitter/cutter 26 left sheets in maximum sizes of three pages. Thus, when letters are to be longer than three pages, it follows that they must be accumulated, and the accumulator has this as its purpose. Such collectors or accumulators are well known in the prior art for collecting sheets at a station prior to "dumping" them in a pile onto a conveyor. Thus, no further description is thought to be necessary.

The letters and self mailers, after being placed on the inserter conveying chains 38 by the accumulator 36, are conveyed by the inserter conveying chains 38 through an inserter 40. The inserter 40 is of the type that is described in detail in U.S. patent application to Morrison et al, Ser. No. 569,989, filed on Apr. 21, 1975, and entitled In-Line Inserter. The teachings in this application are incorporated herein. Generally, this inserter includes hoppers for holding inserts 42*a*, *b* and *c* which are dropped on the letters as they are being conveyed under the hoppers by the inserter conveying chains 38. The letters and the inserts are then stuffed into waiting open envelopes 42 by pusher feet (not shown). The envelopes 42 are supplied from a pile of envelopes 44. The mechanism for moving the envelopes from the pile of envelopes 44 to the open-envelope position 42 is not shown or described herein. In another embodiment the insert hoppers are replaced by roll paper and a cutter.

Once an envelope is stuffed with a folded letter and appropriate inserts, it is conveyed to an inverting station 46 where it is turned up on edge as shown by envelope 48. These envelopes are then fed through a flap sealer 50 which moistens the flaps of the envelopes and seals them against the envelopes, thereby closing the envelopes. Self mailers are fed through the inserter 40 without being further operated upon by the inserter to the inverting station 46. That is, they are merely conveyed without being inserted into an envelope. In this regard, the CPU 18 selectively disables the envelope supply mechanism (not shown) of the inserter 40 to allow the self mailers to merely be conveyed through the inserter 40. The self mailers likewise pass through the flap sealer 50, however, they are not thereby operated on since they have no flaps.

Both the self mailers and the selaed envelopes pass from the flap sealer to a sorter 52, which separates them into one of a plurality of bins 54*a*, *b* or *c* in a stacker and counter 56. Enveloped letters and self mailers may come into the sorting area intermixed. The mail pieces will be carried, on edge through the sorter 52 by a belt conveyor which forms the bottom of a channel. The pieces are sorted by means of the CPU 18 which merely controls a gate in the sorter 52 to direct the mail pieces to either one of the bins 54 *a*, *b* or *c*. In normal operation, the stacker and counter will keep count of letters in each sort bin and will initiate a banding cycle when one sort bin contains a sufficient number of letters. However, this is not shown in the drawing. The letters are normally sorted according to zip codes.

Turning next to the CPU 18 and its operator 58, the heart of the CPU 18 is a shift register (not shown). When the operator 60 orders that a letter be printed and mailed, it provides a 7-bit header data word to an input of the CPU register. This word is then moved through the register in synchronization with the movement of the letter through the overall system. Certain positions of the register correspond to the action positions of the system. The data at these points will be used to generate the correctly timed output commands to be sent to the action mechanisms on the machine. If there are more than one pages in a letter, the subsequent header data words to describe these pages are set at zero. The header data words of the first page contains sufficient information to process subsequent pages. For example, in the case of a two-page letter, when the letter reaches the slitter/cutter 26, data in the register informs the slitter/cutter to count two pages before cutting. Likewise, when this data reaches the first folder position of the register (such that the document has reached the first folder 28) the CPU 18 will transmit a MAKE TWO FOLD command to the folder. The other components of the system receive their commands in the same manner.

In operation of the over-all system, the continuous sheet of paper 12 is tractor fed first through the address and letter printer 16, and then through the perforator 22, and slitter/cutter 26. Under the control of the CPU 18, the address and letter printer 16, the perforator 22 and the slitter/cutter 26, produce letters of one, two or three pages. Also under the control of the CPU 18, the two-and three-page letters are folded to the size of a one-page letter, and one-page letters pass through the first folder 28 without being operated upon. All of these letters, both single-page and multi-page, pass through a second folder 30 in which they are folded to folded letter size. Self mailers are then sealed with seals 34 in the sealer 32 while letters to be inserted into envelopes are merely passed through the sealer 32. Both types of mail pieces are then fed to the accumulator 36 which simply passes self mailers and letters of less than three pages to the inserter conveying-chains 38, but which accumulates letters of more than three pages and also passes them to the conveying chains 38. The conveying chains 38 convey the letters and self mailers under insert piles 42 *a*, *b*, and *c* from which inserts are dropped onto some of these letters. The letters are stuffed into envelopes 42 and both stuffed envelopes and self mailers then pass to the stacker and counter 56 via the sorter 52. The self mailers are not operated on by the inserter 40.

It will be appreciated by those skilled in the art that all documents being processed by the system and method of this invention will follow a single path through the various machines, reducing costs and the complexity of the machines and controls.

Further, self mailers and enveloped letters are treated identically through the major part of the system. Thus, the chance for error is substantially reduced.

Finally, this system provides an economical self mailer in which there is very little chance of page loss, since pages remain attached to one another along perforated lines.

Although this invention has been described herein as being used in a particular preferred embodiment, it should be understood by those skilled in the art that numerous changes and modifications thereto can be made within the spirit and scope of the invention.

I claim:

1. A method for preparing letters to be mailed comprising the steps of:

longitudinally conveying a continuous web of paper, and sheets cut therefrom, along a track through various stations;

printing material corresponding to pages of printed material along the length of said continuous web of paper at a printing station;

cutting the continuous web of paper crosswise between selective ones of said material corresponding to pages of printed material to form individual-page printed sheets, and leaving other sheets as united multi-page printed sheets, at a cutting station;

conveying all said sheets along said track through a folding station and folding said multi-page printed sheets along lateral creases to the size of individual-page printed sheets and allowing said one page sheets to pass therethrough without being folded; and thereafter folding all sheets to a standard folded-letter size.

2. A method as in claim 1 wherein is further included a step of perforating said continuous web between material corresponding to pages of printed material prior to cutting said continuous web.

3. A method as claimed in claim 2, wherein is further included the step of conveying all said letter-size folded sheets through a sealing station and at said sealing station sealing selected ones of of said folded letters and leaving others of said folded letters unsealed, and the step of conveying both said sealed and unsealed letters with the same conveyor through an inserter station and at said inserter station inserting said unsealed letters into envelopes but not inserting said sealed letters into envelopes.

4. A method of preparing mass mailings comprising the steps of:

conveying folded printed sheets along a path through an envelope inserter station;

sealing some of the folded printed sheets and leaving others unsealed at said envelope inserter station placing said unsealed printed sheets in envelopes while said unsealed printed sheets are travelling along said path, and allowing said sealed printed sheets to travel along the same path without being placed into envelopes; and, expelling said thusly enveloped printed sheets and said sealed printed sheets from said envelope inserter station along the same path.

5. A method of preparing mass mailings as in claim 4 wherein some of the said folded printed sheets are multi-paged, with said pages being attached along the edges thereof.

6. A method of preparing mass mailings comprising the steps of:

longitudinally conveying a continuous web of paper upon a track through a printing station;

at said printing station, selectively printing material corresponding to pages of printed material along the length of said continuous web of paper;

conveying said web through a cutting station, and at said cutting station selectively cutting the continuous web of paper crosswise between selective ones of said material corresponding to pages of printed material to form individual-page printed sheets and united multi-page printed sheets;

conveying said individual-page and multi-page printed sheets along the same conveyor through a first folding station, and at said first folding station folding said multi-page printed sheets along lateral creases to the size of the individual-page printed sheets;

thereafter conveying said individual and multi-page printed sheets through a second folding station, and in said second folding station folding all sheets to a standard folded-letter size;

conveying all said letter-size sheets through a sealing station, and at said sealing station selectively sealing some of said letter-size sheets in their folded configurations to form self mailers, but allowing others of said letter-size sheets to pass through said sealing station without being sealed; and thereafter conveying all said letter-size sheets through an envelope inserter station, and at said envelope inserter station placing said unsealed printed sheets in envelopes and allowing said sealed printed sheets to pass through said envelope inserter station without being placed into envelopes.

7. A method as in claim 6 wherein said enveloped and non-enveloped letters are expelled from said envelope inserter station along the same path.

8. A method as in claim 6 wherein said selective cutting at said cutting station cuts said web into sheets of one, two, and three pages.

* * * * *

UNITED STATES PATENT AND TRADEMARK OFFICE

CERTIFICATE OF CORRECTION

PATENT NO. : 3,983,679

DATED : October 5, 1976

INVENTOR(S) : Edward H. Zemke

It is certified that error appears in the above-identified patent and that said Letters Patent are hereby corrected as shown below:

Column 4, line 35, change "60" to --58--; line 44, change "pages" to --page--. Column 5, line 64, delete one "of". Column 6, line 10, after "unsealed", insert a semicolon and begin a new paragraph with "at said envelope...".

Signed and Sealed this

First Day of February 1977

[SEAL]

*Attest:*

RUTH C. MASON
*Attesting Officer*

C. MARSHALL DANN
*Commissioner of Patents and Trademarks*